US006690907B2

(12) United States Patent
Lee

(10) Patent No.: US 6,690,907 B2
(45) Date of Patent: Feb. 10, 2004

(54) FUSING APPARATUS OF ELECTROPHOTOGRAPHIC IMAGE FORMING APPARATUS AND METHOD OF MANUFACTURING THE SAME

(75) Inventor: Kyung-woo Lee, Gyeonggi-do (KR)

(73) Assignee: Samsung Electronics Co., Ltd., Suwon-city (KR)

( * ) Notice: Subject to any disclaimer, the term of this patent is extended or adjusted under 35 U.S.C. 154(b) by 0 days.

(21) Appl. No.: 10/268,086

(22) Filed: Oct. 10, 2002

(65) Prior Publication Data

US 2003/0095819 A1 May 22, 2003

(30) Foreign Application Priority Data

Oct. 10, 2001 (KR) ..... 2001-62359

(51) Int. Cl.[7] ..... G03G 15/20

(52) U.S. Cl. ..... 399/330; 219/216; 399/333; 432/60

(58) Field of Search ..... 399/330, 320, 399/335, 333, 411, 328; 219/216, 469, 619, 628, 629; 165/89, 89 H, 104.21, 90 H; 432/60

(56) References Cited

U.S. PATENT DOCUMENTS 4,533,231 A * 8/1985 Shigenobu ..... 399/331 X
5,426,495 A * 6/1995 Sawamura et al. ..... 165/89
5,611,394 A * 3/1997 Mizuta et al. ..... 165/89
5,887,237 A * 3/1999 Matsumoto et al. ..... 219/469
6,339,211 B1 * 1/2002 Foote et al. ..... 399/330
2002/0118985 A1 * 8/2002 Lee ..... 399/330

FOREIGN PATENT DOCUMENTS

| | | |
|---|---|---|
| JP | 60-55368 | 3/1985 |
| JP | 4-335691 | 11/1992 |
| JP | 4-360185 | 12/1992 |
| JP | 63-48176 | 12/1994 |
| JP | 8-171301 | 7/1996 |
| JP | 8-262905 | 10/1996 |
| JP | 8-305195 | 11/1996 |
| JP | 9-090811 | 4/1997 |
| JP | 11-282294 | 10/1999 |
| JP | 2000-24976 | 1/2000 |

* cited by examiner

*Primary Examiner*—William J. Royer
(74) *Attorney, Agent, or Firm*—Staas & Halsey LLP

(57) ABSTRACT

A fusing apparatus of an electrophotographic image forming apparatus includes an internal pipe having a tubular body portion and end portions integrally formed with the body portion at both ends of the body portion, a heat-generating portion installed to wrap the body portion to be in close contact with the body portion without a gap and to generate heat, and a fusing roller installed to wrap the heat-generating portion. The fusing apparatus provides a perfect contact between the heat-generating portion and the internal pipe, thereby maintaining an entire surface of the fusing roller at a uniform temperature without a temperature deviation. Therefore, an optimal efficiency in fixing a toner image on printer paper can be achieved.

19 Claims, 5 Drawing Sheets

FUSING APPARATUS OF ELECTROPHOTOGRAPHIC IMAGE FORMING APPARATUS AND METHOD OF MANUFACTURING THE SAME

CROSS-REFERENCE TO RELATED APPLICATIONS

This application claims the benefit of Korean Patent Application No. 2001-62359, filed Oct. 10, 2001, in the Korean Intellectual Property Office, the disclosure of which is incorporated herein by reference.

BACKGROUND OF THE INVENTION

1. Field of the Invention

The present invention relates to a fusing apparatus of an electrophotographic image forming apparatus, and more particularly, to a fusing apparatus having an internal pipe maintaining a surface temperature of a fusing roller at a uniform level without a temperature deviation.

2. Description of the Related Art

FIG. 1 is a schematic perspective view of a conventional electrophotographic image forming apparatus. Referring to FIG. 1, the conventional electrophotographic image forming apparatus includes a paper ejecting unit 1, an operating unit 2, a control board cover 3, an upper cover opening button 4, a paper display window 5, a multi-purpose feeding window 6, a paper cassette 7, an option cassette 8, and an auxiliary stand 9.

FIG. 2 is a schematic cross-sectional view of a conventional fusing apparatus 10 of the conventional electrophotographic image forming apparatus employing a halogen lamp as a heat source. Referring to FIG. 2, the conventional fusing apparatus 10 includes a cylindrical fusing roller 11 and a heat-generating portion 12, e.g., the halogen lamp, installed at an interior center of the fusing roller 11.

A coating layer 11*a*, such as Teflon, is coated on a surface of the fusing roller 11. The heating-generating portion 12 generates heat inside the fusing roller 11, and the fusing roller 11 is heated from an interior surface thereof by a radiant heat transmitted from the heat-generating portion 12.

FIG. 3 is a longitudinal sectional view illustrating a relationship between the fusing apparatus 10 and a pressure roller 13 of the conventional electrophotographic image forming apparatus employing the halogen lamp as the heat source as shown in FIG. 2.

Referring to FIG. 3, the pressure roller 13 is disposed to face a paper 14 in a lower portion of the fusing apparatus 10. The pressure roller 13 is elastically supported by a spring device 13*a* to press the paper 14 toward the fusing roller 11 with a predetermined pressure, and the paper 14 passes between the fusing roller 11 and the pressure roller 13. A powdered toner image 14*a* is formed on the paper 14 and is pressed with the predetermined pressure and heated by heat while passing between the fusing roller 11 and the pressure roller 13. In other words, the toner image 14*a* is fixed onto the paper 14 by the heat of the fusing roller 11 and the pressure of the pressure roller 13.

A thermistor 15 measuring the surface temperature of the fusing roller 11 and a thermostat 16 cutting off the supply of power when the surface temperature of the fusing roller 11 exceeds a predetermined set value, are provided at one side of the fusing apparatus 10. The thermistor 15 measures the surface temperature of the fusing roller 11 and transmits an electric signal corresponding to the measured temperature to a controller (not shown) of a printer (not shown). The controller controls an amount of electricity supplied to the halogen lamp 12 according to the measured temperature to maintain the surface temperature of the fusing roller 11 within a given range. When the temperature of the fusing roller 11 exceeds the predetermined set value because the thermistor 15 and the controller fails in controlling the temperature of the fusing roller 11, a contact (not shown) of the thermostat 16 becomes open to cut off the supply of power to the halogen lamp 12.

Such a conventional fusing apparatus using the halogen lamp as the heat source unnecessarily consumes a large amount of electric power. Particularly, when power is turned on, the conventional fusing apparatus requires quite a long warming-up time. In other words, until the fusing roller 11 reaches a desired temperature after applying power, a predetermined time must elapse. The warming-up time may range from several tens of seconds to several minutes. In addition, in the conventional fusing apparatus, since the fusing roller 11 is heated by radiation transmitted from the heat source, heat transmission is slow, and compensation for a temperature deviation caused by a decrease in temperature occurring due to a contact with the paper 14 is slow, so it is difficult to maintain the temperature of the fusing roller 11 constant. Moreover, since the electric power must be periodically applied to the heat source in order to maintain the temperature of the fusing roller 11 constant in a standby mode in which an operation of the printer is in pause, unnecessary electric power is consumed. A considerable time is required to convert the standby mode into an operation mode for an image output, and thus it is difficult to achieve a fast image output.

FIG. 4 is a schematic longitudinal sectional view of another conventional fusing apparatus employed in the electrophotographic image forming apparatus. Referring to FIG. 4, a heating plate 22 is provided at an inner bottom portion of a flexible, cylindrical film tube 21. A pressure roller 23 having a spring device 23*a* is disposed to face the heating plate 22 at a lower portion thereof and the paper 14 is disposed therebetween.

The film tube 21 is rotated by a separate rotating device. Although it consumes a lower power to locally heat a portion between the heating plate 22 and the pressure roller 23, it is difficult to achieve fast printing in the fusing apparatus of FIG. 4.

In order to solve the above problem, fusing apparatuses adopting a heat pipe capable of instantaneously heating the fusing roller using a high heat conductivity and having a low power consumption characteristic are disclosed in Japanese Patent Publication Nos. JP6348176, Hei 11-282294, and Hei 2000-25976.

The fusing apparatuses adopting the heat pipe are configured such that different heat sources are arranged at one portion of the fusing roller, the one portion deviating from a fusion area. Such arrangement of the heat sources may result in an increase in an overall size of the fusing apparatus, which needs to be improved in an increased structural complexity.

The fusing apparatuses disclosed in Japanese Patent Publication Nos. Showa 60-55368, Hei 4-335691, Hei 4-360185, Hei 8-171301, Hei 8-262905, Hei 8-305195 and 9-90811, may not have the increased structural complexity due to the heat source incorporated into the fusing roller. However, since these apparatuses have a plurality of the heat pipes locally disposed in the fusing roller, a manufacturing process is very complex. Also, since the heat pipes are locally disposed in the fusing roller, there is a temperature difference between a space between two adjacent heat pipes and portions directly contacting the heat pipes. Thus, since there is a difference in the surface temperature throughout a heat pipe, the toner image cannot be fixed properly on the paper, and a print quality of the toner image fixed on the paper deteriorates.

SUMMARY OF THE INVENTION

To solve the above and other problems, it is an object of the present invention to provide a fusing apparatus having an internal pipe with improved fusibility by maintaining an entire surface temperature of a fusing roller at a uniform level without a temperature deviation.

Additional objects and advantageous of the invention will be set forth in part in the description which follows and, in part, will be obvious from the description, or may be learned by practice of the invention.

To achieve the above and other objects of the invention, there is provided a fusing apparatus of an electrophotographic image forming apparatus. The fusing apparatus includes an internal pipe having a tubular body portion and end portions integrally formed with the body portion at both ends of the body portion, a heat-generating portion installed to wrap the body portion to be in close contact with the body portion without a gap and to generate heat, and a fusing roller installed so as to wrap the heat-generating portion.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
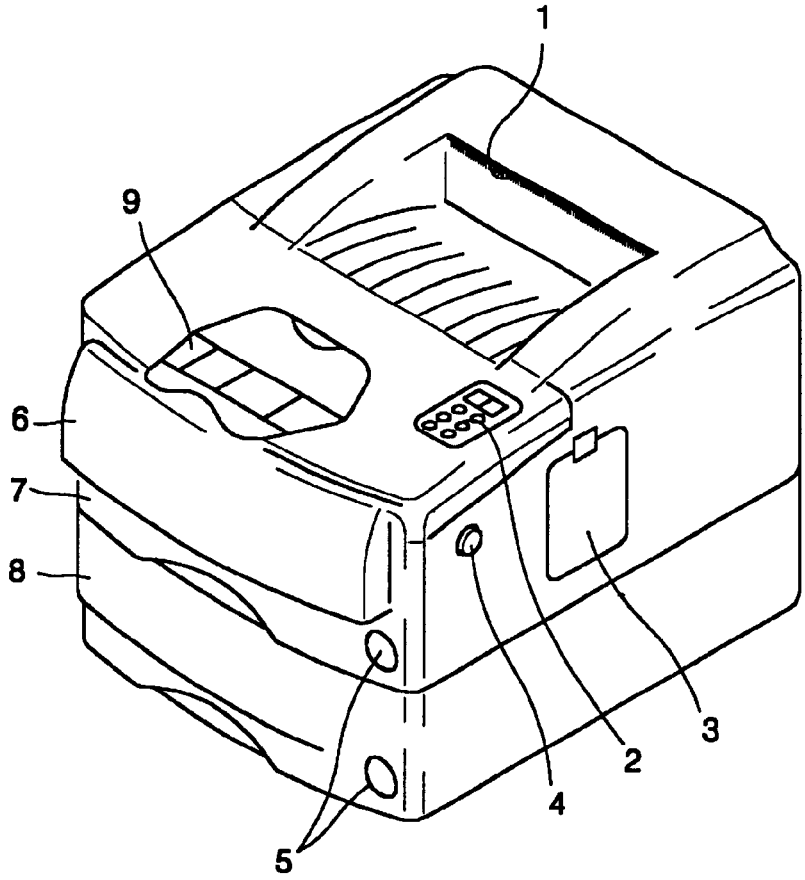
FIG. 1 (PRIOR ART)
FIG. 1 is a perspective view illustrating an outer appearance of a conventional electrophotographic image forming apparatus.
Figure 2:
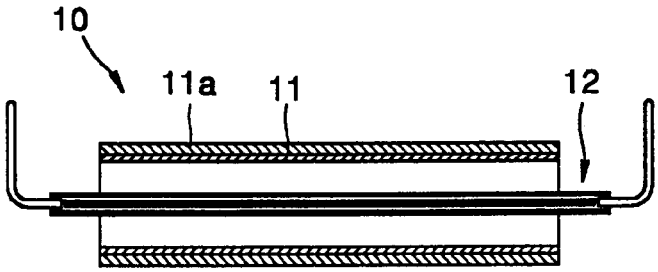
FIG. 2 (PRIOR ART)
FIG. 2 is a schematic cross-sectional view of a fusing apparatus of the conventional electrophotographic image forming apparatus employing a halogen lamp as a heat source.
Figure 3:
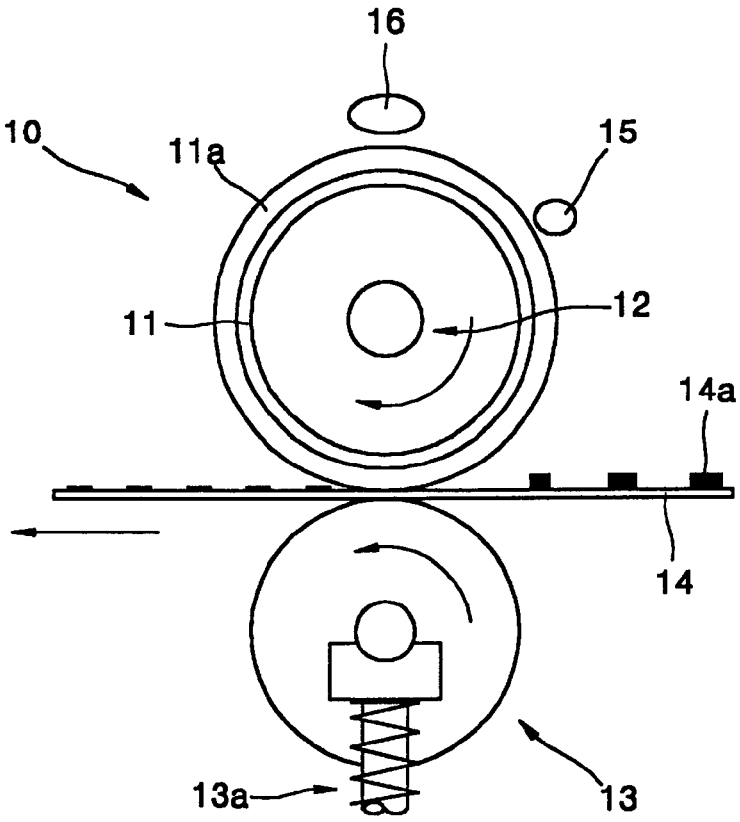
FIG. 3 (PRIOR ART)
FIG. 3 is a cross-sectional view illustrating a relationship between the fusing apparatus and a pressure roller of the conventional electrophotographic image forming apparatus shown in FIG. 2.
Figure 4:
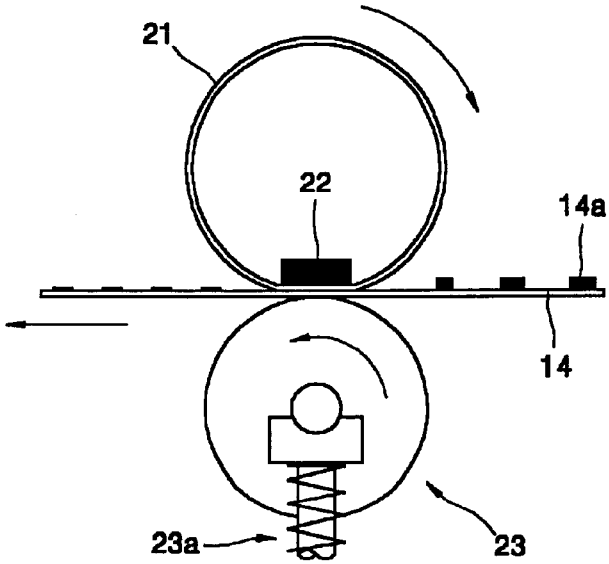
FIG. 4 (PRIOR ART)
FIG. 4 is a schematic cross-sectional view of another conventional fusing apparatus employed in the electrophotographic image forming apparatus of FIG. 1.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 5:
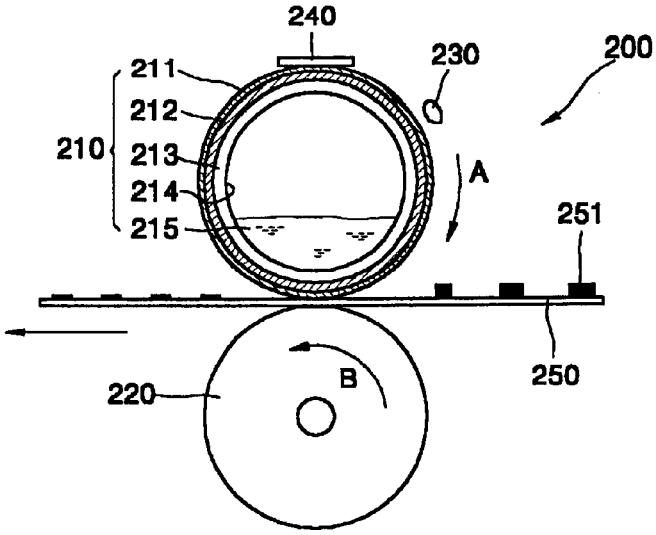
FIG. 5 is a schematic cross-sectional view of a fixing unit having a pressure roller and a fusing apparatus in an electrophotographic image forming apparatus according to an embodiment of the present invention.
Figure 6:
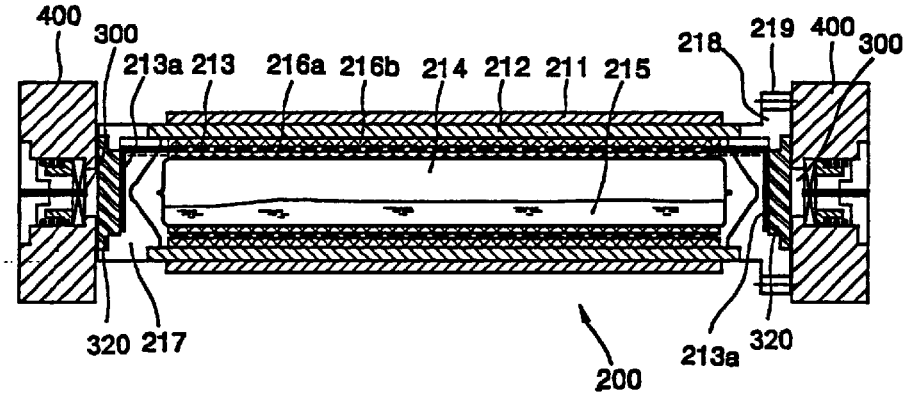
FIG. 6 is a cross-sectional view of the fusing apparatus of the fusing unit shown in FIG. 5.

FIG. 5 is a schematic cross-sectional view of a fixing unit 200 having a fusing apparatus 210 and a pressure roller 220 in an electrophotographic image forming apparatus according to an embodiment of the present invention and FIG. 6 is a cross-sectional view of the fusing apparatus 210 shown in FIG. 5.

Referring to FIGS. 5 and 6, the fusing apparatus 210 rotates in a direction, i.e., in a direction indicated by an arrow A to fix a toner image 251 on a print paper 250, and the pressure roller 220 is installed to face the fusing apparatus 210 through the print paper 250 therebetween and rotates in a direction indicated by an arrow B to be in contact with the fusing apparatus 210.

The fusing apparatus 210 includes a cylindrical fusing roller 212 on which a protective layer 211 is coated with Teflon, an internal pipe 214 which is installed in the cylindrical fusing roller 212 and is sealed at its ends to maintain a predetermined internal pressure, and a heat-generating portion 213 installed between the fusing roller 212 and the internal pipe 214 to generate heat using electric current supplied from a power supply unit 300.

A first insulating layer 216*a* is disposed between the internal pipe 214 and the heat-generating portion 213, and a second insulating layer 216*b* is disposed between the heat-generating portion 213 and the fusing roller 212. In this embodiment, the first and second insulating layers 216*a* and 216*b* are mica. Also, the heat-generating portion 213 is preferably a heat-generating resistive coil wrapping the first insulating layer 216*a*.

A predetermined portion of an internal volume of the internal pipe 214 is filled with a working fluid 215. Also, the power supply unit 300, which is connected to an external power supply to supply the electric current to the heat-generating portion 213, is installed in a frame 400 disposed adjacent to both ends of the fusing roller 212.

A thermistor 230 is mounted on a top of the fusing apparatus 210 in contact with the protective layer 211 to sense surface temperatures of the fusing roller 212 and the protective layer 211. A thermostat 240 is also installed to prevent overheating of the fusing roller 212 by cutting off the supply of the electric current from the power supply unit 300 when the surface temperatures of the fusing roller 212 and the protective layer 211 suddenly rise.

An end cap 217 and a power transmission end cap 218 are installed at corresponding ones of both ends of the fusing roller 212. The power transmission end cap 218 includes a power transmission device 219 to be connected to a separately provided power transmission device (not shown) to rotate the fusing apparatus 210.

Leads 213*a* extending from the heat-generating portion 213 are disposed at the end cap 217 and the power transmission end cap 218, respectively. The leads 213*a* contact electrodes 320 connected to the power supply unit 300 to electrically connect the electrode 320 to the heat-generating portion 213.

Thus, the electric current supplied from the power supply unit 300 is transferred to the heat-generating portion 213 via the leads 213*a*.

Figure 7:
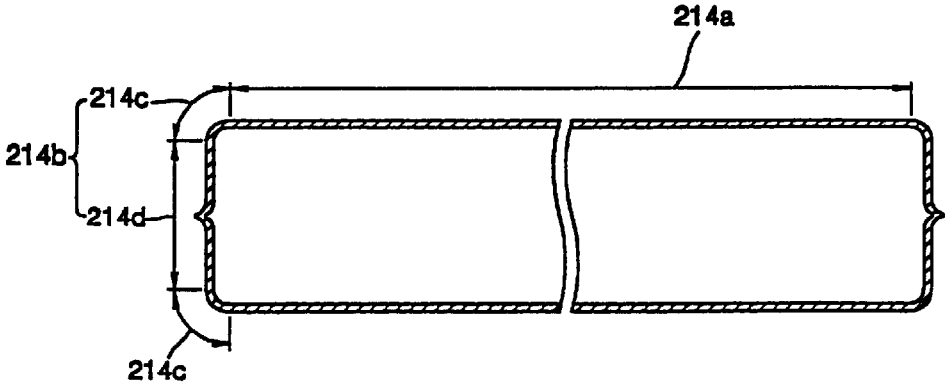
FIG. 7 is a cross-sectional view illustrating an internal pipe of the fusing apparatus shown in FIG. 6.

FIG. 7 is a cross-sectional view illustrating the internal pipe 214 of the fusing apparatus 210 shown in FIG. 6. Referring to FIG. 7, the internal pipe 214 includes a body portion 214*a* and end portions 214*b*.

The body portion 214*a* and end portions 214*b* are integrally formed, but they are defined by different terms as an example. The heat-generating portion 213 and the internal pipe 214 substantially contact each other through the first insulating layer 216*a* disposed therebetween, and the heat-generating portion 213 and the fusing roller 212 substantially contact each other through the second insulating layer 216*b* disposed therebetween. Since the first and second insulating layers 216*a* and 216*b* are very thin, it is assumed that the heat-generating portion 213 directly contacts the fusing roller 212 and the internal pipe 214.

As described above, the body portion 214*a* receives the heat generated from the heat-generating portion 213 and transfers the heat to the working fluid 215. The working fluid 215 evaporates by the transferred heat. The evaporation heat of the working fluid 215 is transferred to the fusing roller 212 via the body portion 214*a*.

In order for the fusing apparatus 210 to fix the toner image 251 on the print paper 250 in a stable manner, it is necessary to maintain an entire surface of the fusing roller 212 at a uniform surface temperature without a temperature deviation.

If a close contact between the body portion 214*a* and both ends of the heat-generating portion 213 is not provided, that is, if the body portion 214*a* and both ends of the heat-generating portion 213 are spaced apart from each other, air may be induced to a gap produced therebetween, which lowers a heat transmission efficiency with respect to the fusing roller 212.

Thus, unlike the case in which the entire surface temperature of the fusing roller 212 is uniformly maintained by forming a perfectly close contact between the body portion 214*a* and the heat-generating portion 213, there is a temperature difference generated throughout the surface of the fusing roller 212, thereby an efficiency in fixing the toner image 251 on the print paper 250 deteriorates.

The internal pipe 214 is formed in a tube type through first mechanical processing, and both ends thereof are sealed by secondary mechanical processing, e.g., forging. As described above, in order to prevent generation of the temperature difference throughout the entire surface of the fusing roller 212, the body portion 214*a* is not subjected to the secondary mechanical processing. Thus, since the body portion 214*a* is not hardened through processing, the body portion 214*a* has ductility.

It is possible that a length of the body portion 214*a* is the same as the heat-generating portion 213 or longer than that of the heat-generating portion 213.

Thus, if the internal pipe 214 is extended (heated), the body portion 214*a* is also extended (expanded) to a predetermined length (diameter) so that the heat-generating portion 213 and the fusing roller 212 become in close contact with each other without a gap. Here, in order to easily extend the body portion 214*a* to allow the body portion 214*a* to be in close contact with the heat-generating portion 213 contacting the fusing roller 212, a heat treatment on the body portion 214*a* is preferably performed at 500 to 900° C.

Consequently, the fusing roller 212, the heat-generating portion 213 and the body portion 214*a* are brought into perfectly close contact with each other so that the heat generated from the heat-generating portion 213 is transferred to the body portion 214*a* and the evaporation heat of the working fluid 215, transferred from the body portion 214*a*, is transferred to the fusing roller 212. Thus, the uniform surface temperature of the fusing roller 212 is maintained throughout the entire surface of the fusing roller 212 without the temperature deviation.

Both of the end portions 214*b* include a curved portion 214*c* connected to the body portion 214*a* and a sealing portion 214*d* connected to the curved portion 214*c* to hermetically seal an internal space of the internal pipe 214.

The end portions 214*b* are formed by the secondary mechanical processing. In a course of performing the secondary mechanical processing, hardening may occur in the body portion 214*a* of the internal pipe 214. Accordingly, the second mechanical processing is one of forging or swaging.

Thus, when the internal pipe 214 is disposed inside the heat-generating portion 213, and when a predetermined pressure is applied to the internal pipe 214 to extend (expand) the internal pipe 214, the body portion 214*a* having ductility is easily extendable (expandable) but it is difficult for the both end portions 214*b* to be extended (expanded) since both end portions 214*b* have been already hardened. Shapes of both end portions 214*b* are not limited to those shown in this embodiment but various modifications can be made.

As described above, the present invention features that the body portion 214*a* is processed so as to have ductility without being hardened, to thus provide perfectly close contact between the fusing roller 212 and the heat-generating portion 213 when the internal pipe 214 is extended, thereby maintaining the entire surface of the fusing roller 212 at a uniform temperature without the temperature deviation.

Figure 8:
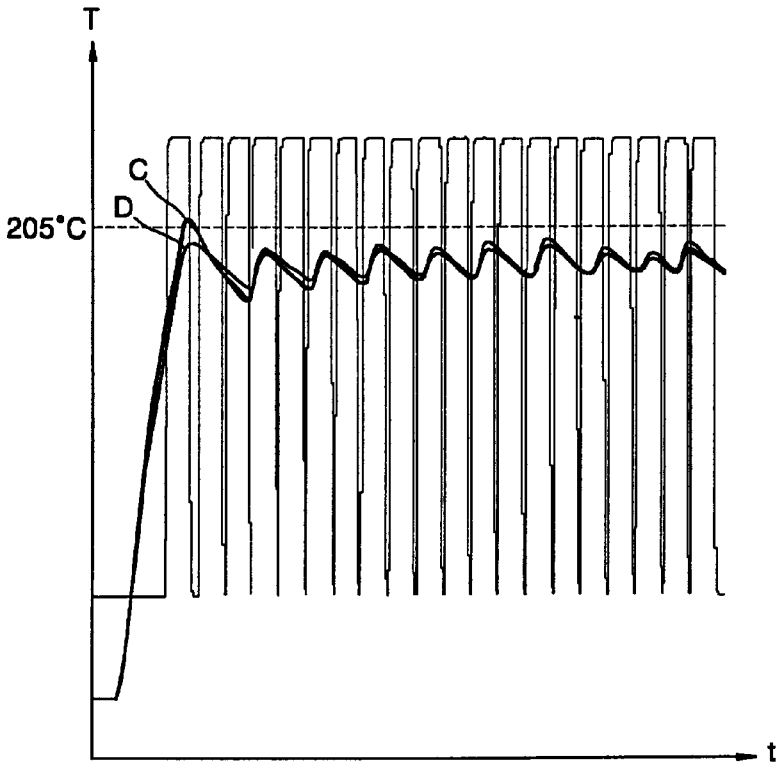
FIG. 8 is a graph showing temperatures measured at a center and ends of a fusing roller of the fusing apparatus shown in FIG. 6.

FIG. 8 is a graph showing temperatures measured at a center and ends of the fusing roller 212 shown in FIGS. 5 and 6. Referring to FIG. 8, reference mark C denotes a curve indicating the temperatures measured at the center of the fusing roller 212, and reference mark D denotes a curve indicating the temperatures measured at both ends of the fusing roller 212.

In FIG. 8, the abscissa indicates time (t) and the ordinate indicates temperature (T). At an initial heating stage, power is supplied to the heat-generating portion 213 within a short time, and there is the temperature difference between the center and both ends of the fusing roller 212. However, the temperature difference is reduced in a very short period of time. That is, the temperature difference between the center and both ends of the fusing roller 212 is approximately 3° C. or less.

As described above, the fusing apparatus 210 of the electrophotographic image forming apparatus according to the present invention can provide the perfect contact between the heat-generating portion 213 and the fusing roller 212 and the internal pipe 214, thereby maintaining the fusing roller 212 at a constant temperature throughout the entire surface of the fusing roller 212 without the temperature difference. Therefore, an optimal efficiency in fixing the toner image on the print paper can be achieved.

Although an embodiment of the present invention has been shown and described, it would be appreciated by those skilled in the art that changes may be made in this embodiment without departing from the principles and sprit of the invention, the scope of which is defined in the claims and their equivalents.

What is claimed is:

1. A fusing apparatus of an electrophotographic image forming apparatus, comprising:

an internal pipe having a tubular body portion and end portions integrally formed with the tubular body portion at ends of the body portion;

a heat-generating portion installed to wrap the tubular body portion to be in contact with the tubular body portion without a gap and to generate heat; and a fusing roller installed to wrap the heat-generating portion.

2. The fusing apparatus of claim 1, wherein the tubular body portion of the internal pipe has a length equal to or greater than that of the heat-generating portion in a longitudinal axial direction of the internal pipe.

3. The fusing apparatus of claim 2, wherein the end portions of the internal pipe are formed by using forging to seal the internal pipe.

4. The fusing apparatus of claim 1, wherein the end portions of the internal pipe are formed by using swaging to seal the internal pipe.

5. The fusing apparatus of claim 1, wherein the tubular body portion of the internal pipe has ductility, and the end portions of the internal pipe are hardened not to have the same ductility as the tubular body portion of the internal pipe.

6. The fusing apparatus of claim 1, wherein the end portions of the internal pipe are hardened, and the tubular body portion of the internal pipe is not hardened to have ductility.

7. The fusing apparatus of claim 1, wherein the tubular body portion of the internal pipe comprises:

a curved portion formed between the tubular body portion and the end portions, and the tubular body portion has a length equal to or greater than that of the heat-generating portion in a longitudinal axial direction of the internal pipe.

8. The fusing apparatus of claim 7, wherein the tubular body portion of the internal pipe comprises:

a portion connected to the curved portion and contacting the heat-generating portion without a gap to prevent a low heat transmission efficiency between the portion of the tubular body portion and the heat-generating portion.

9. The fusing apparatus of claim 1, wherein the internal pipe contains a working fluid evaporating when the heat-generating portion generates heat.

10. A fusing apparatus of an electrophotographic image forming apparatus, comprising:

an internal pipe having a tubular body portion having a first length in a longitudinal direction of the internal pipe, and having end portions integrally formed with the tubular body portion at opposite ends of the tubular body portion to seal the internal pipe;

a heat-generating portion wrapping the tubular body portion through the length of the tubular body portion to be in contact with the tubular body portion without a gap and to generate heat, having a second length in the longitudinal direction of the internal pipe; and a fusing roller wrapping the heat-generating portion, wherein the internal pipe contains a working fluid evaporating when the heat-generating portion generates heat.

11. The fusing apparatus of claim 10, wherein the first length of the tubular body portion of the internal pipe is equal to or greater than the second length of the heat-generating portion.

12. The fusing apparatus of claim 10, wherein the tubular body portion comprises:

a circular cylindrical hollow pipe.

13. The fusing apparatus of claim 10, wherein the heat-generating portion is disposed around the tubular body portion of the internal pipe in the longitudinal direction of the internal pipe and in a circular direction of the internal pipe.

14. The fusing apparatus of claim 10, wherein the end portions of the internal pipe are disposed to face each other through the tubular body portion.

15. The fusing apparatus of claim 10, wherein the end portions of the internal pipe are formed by using one of forging and swaging.

16. The fusing apparatus of claim 10, wherein the tubular body portion of the internal pipe has ductility, and the end portions of the internal pipe are hardened not to have the same ductility as the tubular body portion of the internal pipe.

17. The fusing apparatus of claim 10, wherein the end portions of the internal pipe are hardened, and the tubular body portion of the internal pipe is not hardened to have ductility.

18. The fusing apparatus of claim 10, wherein the internal pipe comprises:

a curved portion formed between the tubular body portion and the end portions.

19. The fusing apparatus of claim 18, wherein the tubular body portion of the internal pipe comprises:

a portion connected to the curved portion and contacting the heat-generating portion without a gap to prevent a low heat transmission efficiency between the portion of the tubular body portion and the heat-generating portion.

* * * * *

UNITED STATES PATENT AND TRADEMARK OFFICE

CERTIFICATE OF CORRECTION

PATENT NO. : 6,690,907 B2
DATED : February 10, 2004
INVENTOR(S) : Kyung-woo Lee

It is certified that error appears in the above-identified patent and that said Letters Patent is hereby corrected as shown below:

Title page,
Item [56], References Cited, FOREIGN PATENT DOCUMENTS, please add:

-- KR U1992-0025937 12/1992 --

Signed and Sealed this

First Day of June, 2004

JON W. DUDAS
*Acting Director of the United States Patent and Trademark Office*